US005121811A

United States Patent [19]

Shima et al.

[11] Patent Number: 5,121,811

[45] Date of Patent: Jun. 16, 1992

[54] NOISE REDUCING DEVICE FOR PRINTER

[75] Inventors: Hiroshi Shima, Kodaira; Masanori Murase; Naotaka Tomita, both of Sayama; Kazuyoshi Iida, Yokohama, all of Japan

[73] Assignee: Bridgestone Corporation, Tokyo, Japan

[21] Appl. No.: 467,426

[22] Filed: Jan. 19, 1990

[30] Foreign Application Priority Data

Jan. 27, 1989 [JP] Japan ..... 1-16358
Dec. 14, 1989 [JP] Japan ..... 1-322727

[51] Int. Cl.[5] ..... B41J 29/08
[52] U.S. Cl. ..... 181/201; 400/689
[58] Field of Search ..... 181/198, 200, 201, 204, 181/268; 400/690, 689, 690.1, 690.2, 690.3, 690.4

[56] References Cited

U.S. PATENT DOCUMENTS

| | | | |
|---|---|---|---|
| 4,093,040 | 6/1978 | Treiber | 181/262 X |
| 4,212,369 | 7/1980 | Zeilinger | 181/268 X |
| 4,212,370 | 7/1980 | Drener et al. | 181/268 X |
| 4,252,453 | 2/1981 | Estabrooks | 181/201 X |
| 4,753,318 | 6/1988 | Mizuno et al. | 181/204 |
| 4,840,251 | 6/1989 | Murase et al. | 181/200 X |
| 4,943,173 | 7/1990 | Okazaki et al. | 181/201 X |

FOREIGN PATENT DOCUMENTS

| | | |
|---|---|---|
| 52-124716 | 10/1977 | Japan . |
| 60-162680 | 8/1985 | Japan . |
| 64-90497 | 4/1989 | Japan . |

OTHER PUBLICATIONS

IBM Technical Disclosure Bulletin, vol. 24, No. 4, Sep. 1981, New York US p. 1798 S. Alexander "Acoustic Hood for a Typewriter".

IBM Technical Disclosure Bulletin, vol. 18, No. 4, Sep. 1975, New York US pp. 1150–1151, F. A. Goplen, "Acoustical Enclosure".

*Primary Examiner*—L. T. Hix
*Assistant Examiner*—Eddie C. Lee
*Attorney, Agent, or Firm*—Sughrue, Mion, Zinn, Macpeak & Seas

[57] ABSTRACT

A noise reducing device for printers including a noise reducing hollow body consisting of at least one hollow duct at one side of a sheet delivery opening opposedly arranged to a printed sheet guiding-receiving member positioned at the other side of the sheet delivery opening, and the hollow duct is oriented such that a noise outlet thereof is opened towards the upper surface of the sheet guiding-receiving member.

6 Claims, 8 Drawing Sheets

NOISE REDUCING DEVICE FOR PRINTER

BACKGROUND OF THE INVENTION (1) Field of the Invention

The present invention relates to a noise reducing device for reducing noise radiating from a printer of business equipment which is used in offices of the like.

(2) Related Art Statement

Hitherto, there is a problem of noise radiating from printers of business equipment. It is however impossible to completely shield a sheet supply opening and a sheet delivery opening in the printer in order to prevent noise from radiating out of the printer. Accordingly, it has been required to reduce noise radiating from the sheet delivery opening located near a printing drum of the printer.

A noise reducing device for printer is disclosed in Japanese Patent Application publication Laid-open No. 60-162680 in which a conventional interfering type noise reducing hollow body consisting of a plurality of hollow ducts having different passage lengths is arranged at one side of the sheet delivery opening of the printer. However, the noise reducing device described in the publication is vertically mounted on the upper surface of an outer casing of the printer at one side of the sheet delivery port and arranged such that a printed sheet is guided from the sheet delivery opening over the upper end of the noise reducing hollow body along the noise incident side thereof. Therefore, a portion of noise radiating from the sheet delivery opening enters into the hollow ducts having different passage lengths of the noise reducing device via each of noise incident inlets of the hollow ducts which is opened at the side of the sheet delivering opening. The portion of the noise passes through the hollow ducts and is controlled by the different passage lengths and then radiated from outlets at the radiate side of the noise reducing device with different phases depending on the different passage length. Therefore, the controlled noise radiated from the outlets are interfered to each other to reduce the level of noise. The remainder of noise radiated from the sheet delivery opening passes along the printed sheet without passing into the hollow ducts and is directly propagated over the upper end of the noise reducing device. Such directly propagated noise is also interfered with the controlled noise having different phases at the radiating side of the device to be reduce the level of the noise.

The aforementioned interfering type noise reducing device, however, has disadvantages that the construction is bulky and a part of the directly propagated noise passing along the printed sheet is upwardly propagated and is not effectively interfered with the controlled noise having different phases so that the noise reducing effect is not so sufficient as expected because the noise reducing device is vertically mounted on the upper surface of the printer and the remainder of the noise from the sheet delivery opening is mainly upwardly propagated along the upper surface of the printed sheet which is guided over the upper end of the noise reducing device.

SUMMARY OF THE INVENTION

The invention is made by taking the above prior art into consideration. Accordingly, it is an object of the present invention to provide a noise reducing device adapted for effectively reducing noise radiated from the sheet delivery opening of the printer.

According to the present invention, there is provided a noise reducing device for printers including a noise reducing hollow body consisting of at least one hollow duct at one side of a sheet delivery opening oppositely arranged to a printed sheet guiding-receiving member positioned at the other side of the sheet delivery opening. The hollow duct is oriented such that a noise outlet thereof is opened towards the upper surface of the sheet guiding-receiving member.

In accordance with the above arrangement of the noise reducing device of the present invention, for example, as shown in FIG. 2, when directly propagated noise from the sheet delivery opening 3 passing through a passage having a length "$L_1$" meets with a controlled noise passed through the hollow duct 6 having a passage length of "$L_2$", interference is caused between the directly propagated noise and the controlled noise by a phase shift of $L_1 - L_1$ so that a noise reducing effect is obtained. Accordingly, the noise radiated from the sheet delivery opening can be effectively reduced by interfering all noises passed through the hollow ducts having different passage lengths with the directly propagated noise.

According to the present invention, it is preferable that the length of hollow ducts is stepwise varied to become the length of hollow ducts positioned far from the sheet delivery opening longer. Further, the hollow ducts are formed in the form of a straight duct having the same sectional area and are arranged parallely to each other and to the sheet delivery opening side. According to such an arrangement, noise can uniformly enters into each of the hollow ducts from the sheet delivery opening, and the phase shift is continuously caused with a frequency corresponding to the length of each hollow duct, so that the controlled noise radiated from the hollow ducts are uniformly interfered to reduce the noise in a range of noise reducing target frequency uniformly and effectively.

Moreover, according to the present invention, it is preferable to arrange the hollow ducts so that a sectional area of a noise incident passage extending from the sheet delivery opening to the inlets of hollow ducts is gradually decreased from the sheet delivery opening side to uniformly introduce the noise into each of hollow ducts. Moreover, it is preferable to make a noise entering angle formed by the noise incident passage and each of the hollow ducts larger than 90° to smoothly introduce the noise from the noise incident passage to the hollow ducts.

The invention will be now described more in detail with reference to the accompanying drawings.

DETAILED DESCRIPTION OF THE PREFERRED EMBODIMENTS

Figure 1:
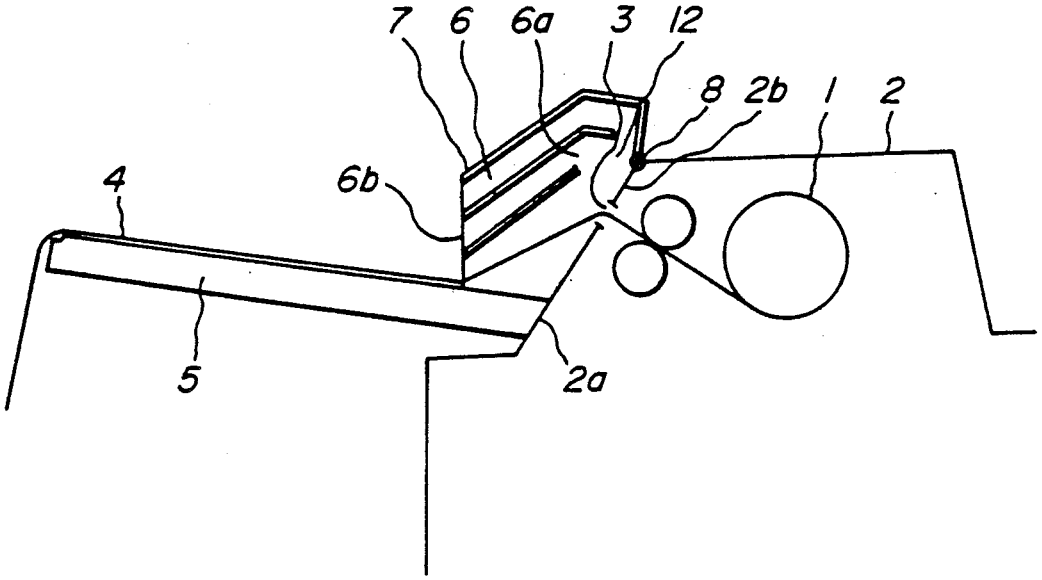
FIG. 1 is a diagrammatic sectional view illustrating the first embodiment of the present invention.
Figure 2:
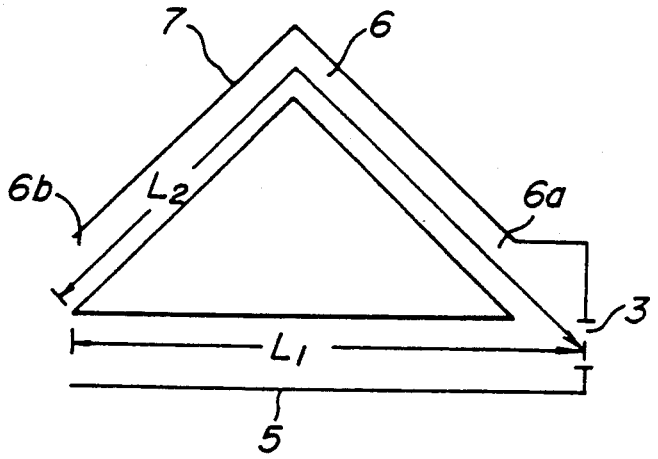
FIG. 2 is a schematic view showing interference of noise in a noise reducing device according to the present invention.

Referring to FIG. 1 illustrating the first embodiment of the present invention, a printer 1 includes a casing 2 provided with a printed sheet delivery opening 3. At one side 2*a* of the sheet delivery opening 3 the printer casing 2 is provided with a printed sheet guiding-receiving member 5 extended therefrom for guiding and/or receiving a printed sheet 4 delivered from the sheet delivery opening 3.

At the other side 2*b* of the sheet delivery opening 3, a noise reducing hollow body 7 is hinged to the printer casing 2 by means of a hinge shaft 8 to rotate from a operation position where the sheet delivery opening 3 is covered by the body as shown in FIG. 1 to an unoperative position where the sheet delivery opening 3 is opened.

The noise reducing hollow body 7 is composed of a plurality of hollow ducts 6 having different passage lengths. In the operation position of the noise reducing hollow body as shown in FIG. 1, a portion of noise radiated from the sheet delivery opening 3 enters into the hollow ducts 6 through a noise incident passage 12, and is radiated from the noise outlets 6*b* of the hollow ducts towards the upper surface of the guiding-receiving member 5 after passing through the passages of different length of the hollow ducts 6. The remainder of the noise radiated from the sheet delivery opening 3 does not pass through the hollow ducts 6, and is directly propagated from the sheet delivery opening 3 along the upper surface of the guiding receiving member 5 or the printed sheet 4 delivering from the sheet delivering opening 3.

Figure 3:
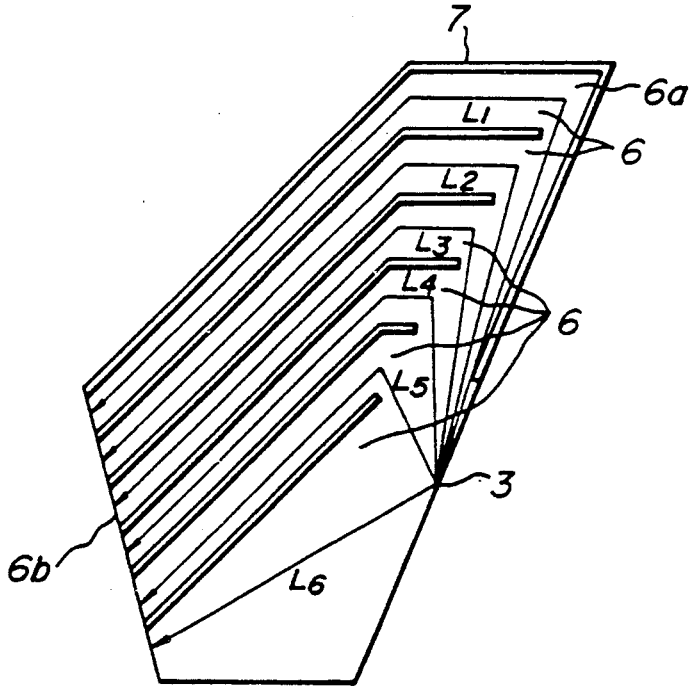
FIG. 3 is a diagrammatic sectional view of an embodiment of the noise reducing hollow body as shown in FIG. 1.

FIG. 3 illustrates an embodiment of the noise reducing hollow body shown in FIG. 1. The noise reducing hollow body 7 is composed of five hollow ducts 6 having different passage lengths of $L_1$: 140 mm, $L_2$: 120 mm, $L_3$: 100 mm, $L_4$: 80 mm and $L_5$: 60 mm and a directly propagating passage having a passage length of $L_6$: 40 mm.

Figure 4:
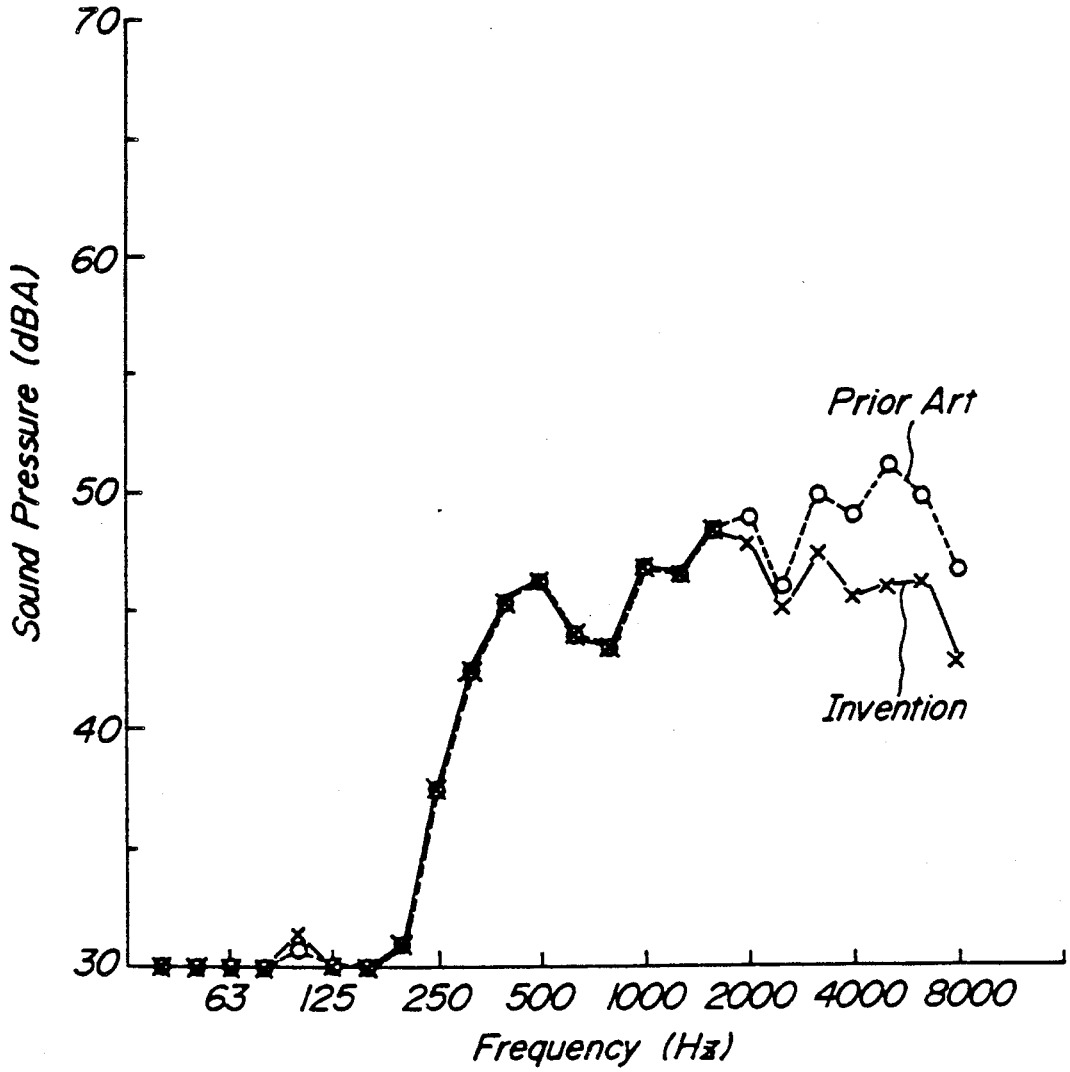
FIG. 4 is a graph of sound pressure spectrum showing a sound reducing effect of the first embodiment of the present invention by comparing with the prior art.

The graph of FIG. 4 comparatively shows spectrums of sound pressure levels of noise radiated from the sheet delivery opening of a printer provided with the noise reducing device shown in FIG. 1 including the noise reducing hollow body shown in FIG. 3 and noise from a printer without a noise reducing device. These are measured at a bystander position according to standard of ISO-7779. It will be seen from the graph shown in FIG. 4, the noise reducing device according to the embodiment of the present invention has a high noise reducing effect in a range of frequency higher than 3 KHz and the overall noise reducing effect of 2.9 dB.

Figure 5:
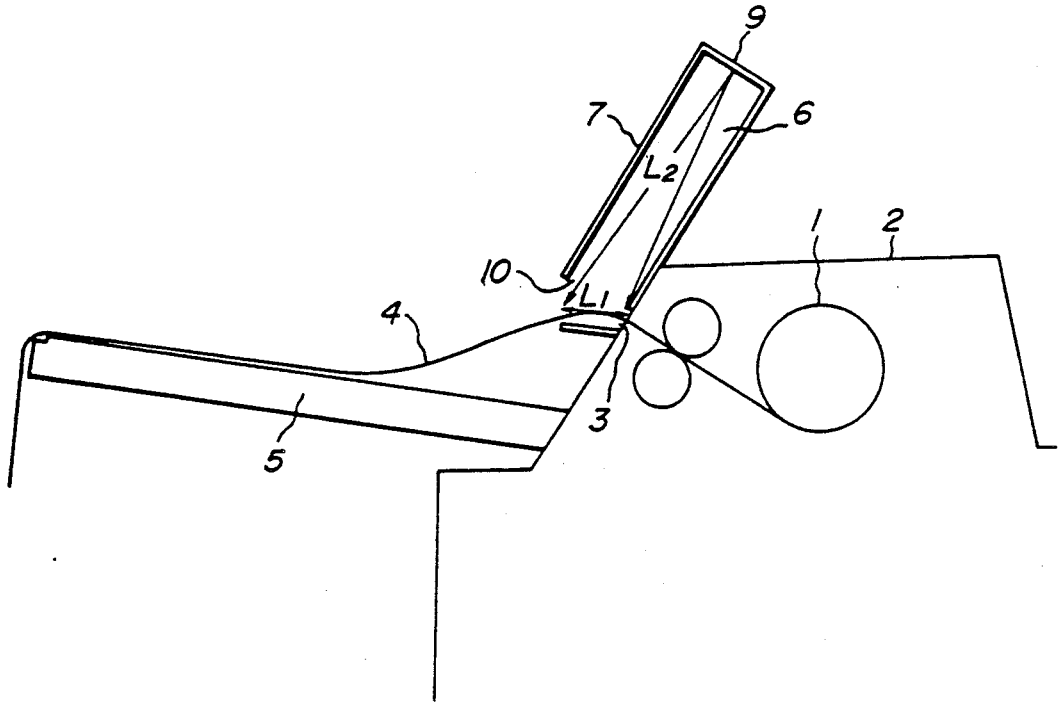
FIG. 5 is a diagrammatic sectional view illustrating the second embodiment of the present invention.
Figure 6:
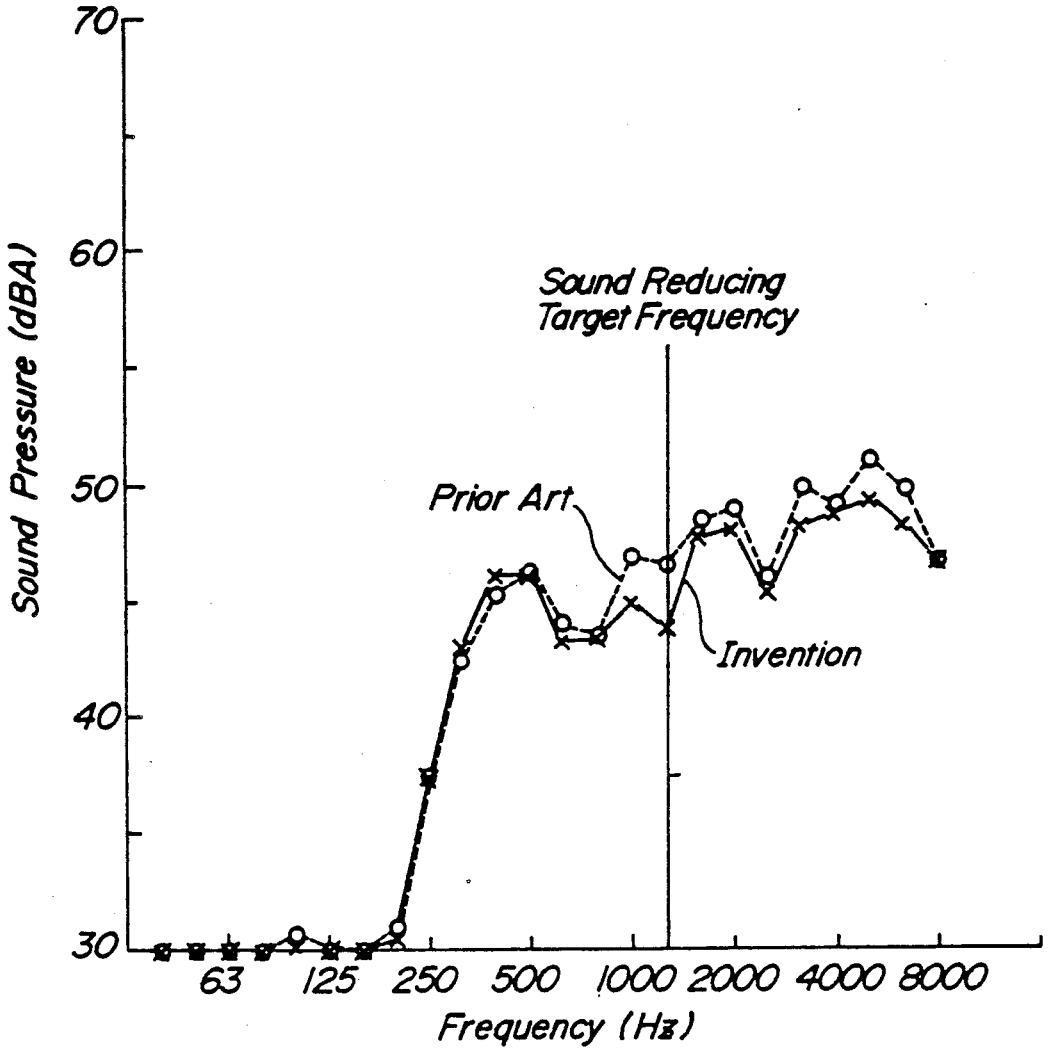
FIG. 6 is a graph of sound pressure spectrum showing a sound reducing effect of the second embodiment of the present invention by comparing with the prior art.

FIG. 5 illustrates another embodiment of the present invention. In this embodiment, a printer 1 is provided with a noise reducing hollow body 7 having a hollow duct 6 opened at one side of a printed sheet delivery opening 3. The hollow duct 6 has a closed end 9 and an opened end 10 and is arranged so that a portion of noise radiated from the sheet delivery opening 3 enters into the hollow duct 6 from the opened end 10, and after reflected at the closed end 9, the controlled noise is radiated from the opened end 10 towards the upper surface of the sheet guiding-receiving member 5.

Referring to FIG. 5, a passage length "$L_1$" of the directly propagated noise between the opened end 10 of the hollow duct 6 and the sheet delivery opening 3 is very short, while a passage length "$L_2$" of the controlled noise radiated from the open end 10 after reflected at the closed end 9 of the hollow duct 6 is one fourth of the wave length of noise at the sound reducing target frequency to be reduced.

In this embodiment, the incident noise entering into the hollow duct is reflected at the closed end thereof and is radiated from the open end 10 with a phase difference of one half of the wave length ($L_2-L_1$). Accordingly the phase difference between the directly propagating noise passed through a passage having a length "$L_1$" and the controlled noise radiated from the hollow duct 6 having a passage length of "$L_2$" is one half of the wave length, so that a very high noise reducing effect is obtained.

Figure 7:
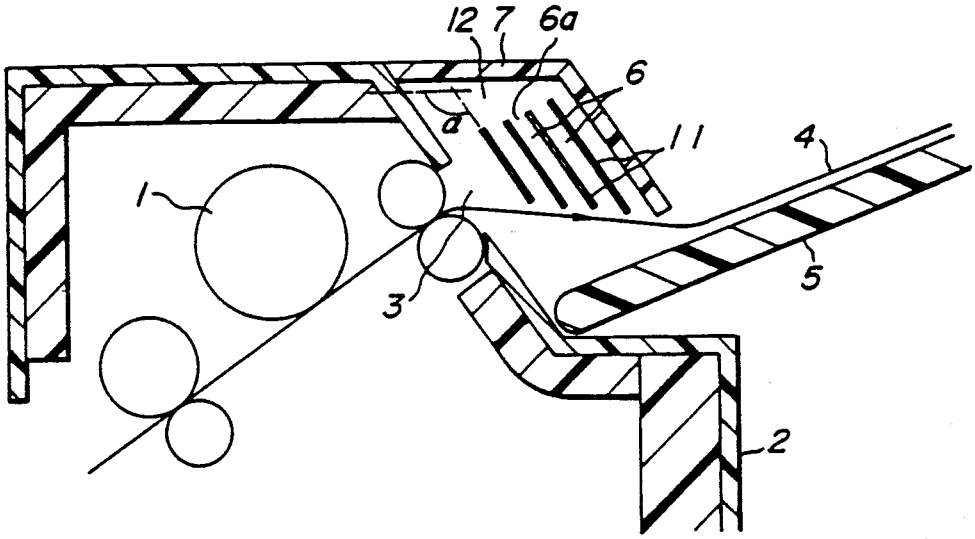
FIG. 7 is a diagrammatic sectional view illustrating the third embodiment of the present invention.
Figure 8:
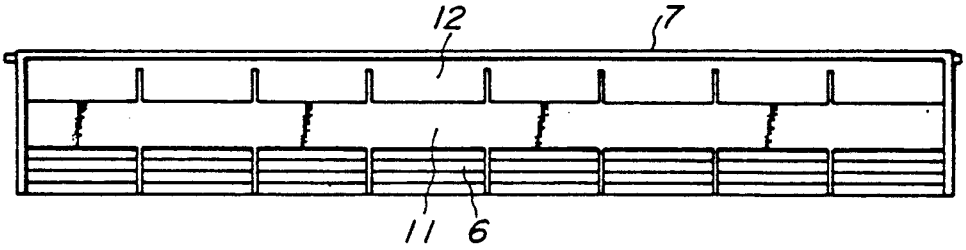
FIG. 8 is a bottom view of the noise reducing hollow body shown in FIG. 7.
Figure 9:
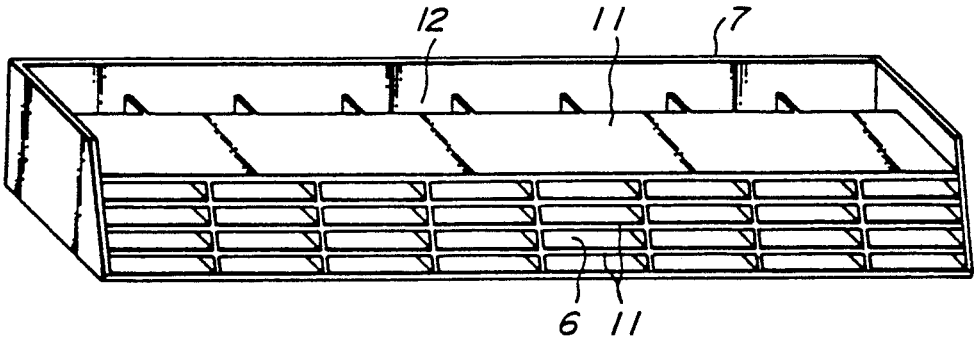
FIG. 9 is a perspective bottom view of the noise reducing hollow body shown in FIG. 7.

FIG. 7 shows a preferred embodiment of the present invention. In this embodiment, the noise reducing hollow body 7 is oppositely positioned to the printed sheet guiding-receiving plate 5 located at one side of the printed sheet delivery opening 3 of the printer, and is hinged to the casing 2 of the printer at the other side of the sheet delivery opening 3. The noise reducing hollow body 7 is provided with a plurality of plates 11 therein. For example, these plates have the same thickness of 1.5 mm and are parallel spaced apart by the same distance of 4.5 mm. The plates have different lengths and the lengths of the plates measured from an end positioned at a noise incident passage 12 to the other end at the radiate side of the noise reducing hollow body are stepwise varied for example by making with the length of 22 mm, 26 mm, 30 mm and 34 mm from the sheet delivery opening side to provide a plurality of hollow ducts 6 having different length to become the length of hollow ducts positioned far from the sheet delivery opening longer. Accordingly, the incident passage 12 extending from the sheet delivery opening 3 to the inlets of hollow ducts 6 has a sectional area which gradually decreases from the sheet delivery opening side. A noise entering angle $\alpha$ formed by a longitudinal axis of the noise incident passage and a longitudinal axis of each of the hollow ducts is larger than 90°. FIGS. 8 and 9 are a bottom view and a perspective bottom view of the interference type noise reducing hollow body shown in FIG. 7, respectively.

Figure 10:
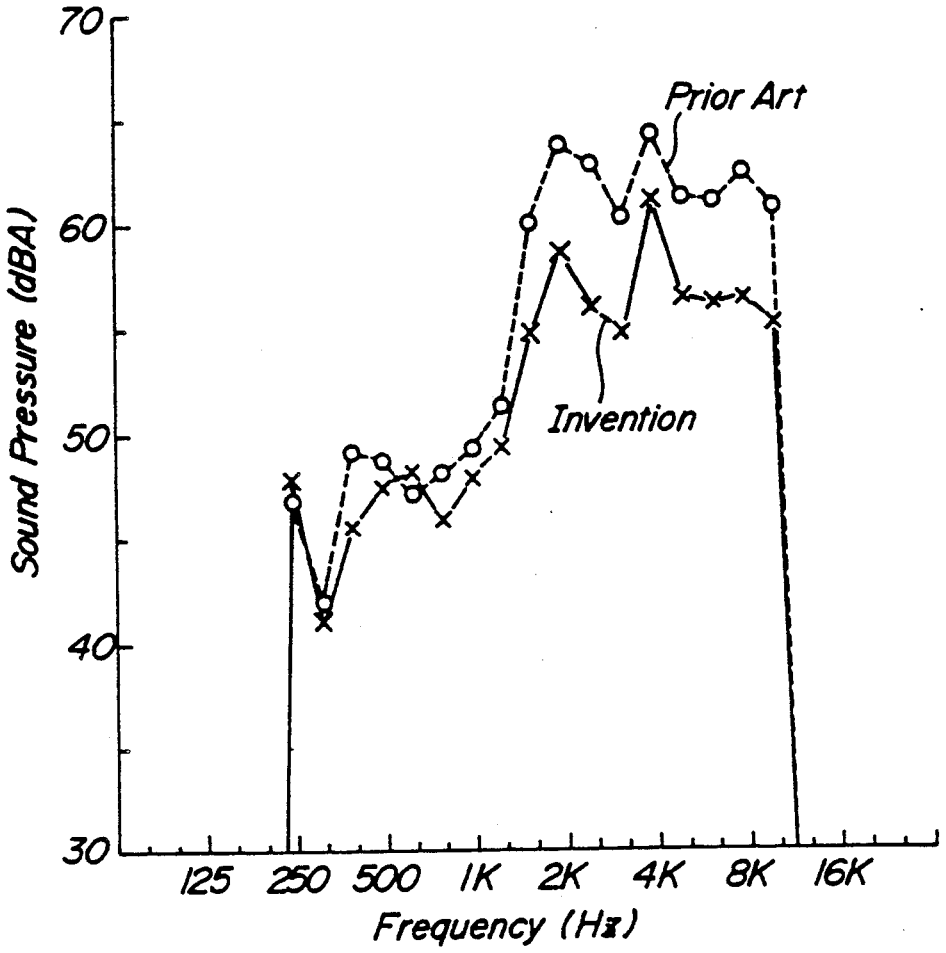
FIG. 10 is a graph of sound pressure spectrum showing a sound reducing effect of the third embodiment of the present invention by comparing with the prior art.

The graph of FIG. 10 comparatively shows spectrums of sound pressure levels of noise radiated from the sheet delivery opening of a printer provided with the noise reducing device shown in FIG. 7 and noise from a printer without a noise reducing device. It will be seen from the graph shown in FIG. 10, the noise reducing device according to the embodiment of the present invention has a high noise reducing effect in a range of frequency higher than 1.5 KHz.

Figure 11:
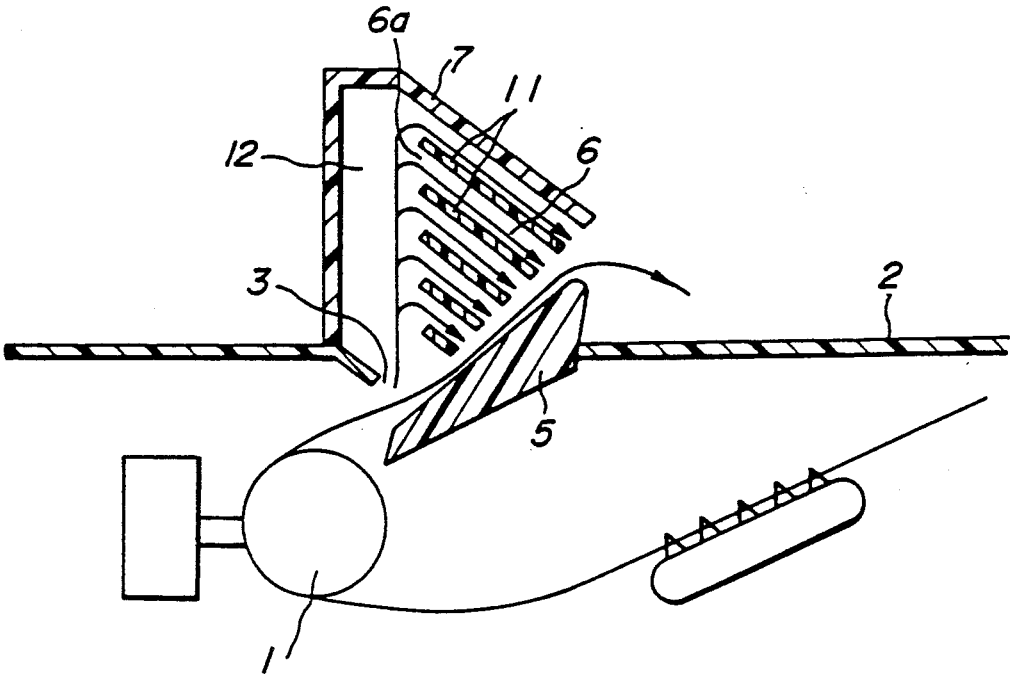
FIG. 11 is a diagrammatic sectional view illustrating the fourth embodiment of the present invention.

FIG. 11 illustrates another embodiment of the present invention. This embodiment is substantially the same as that of FIG. 7 except that the printer 1 is provided with a printed sheet guiding member 5 inclined relative to the horizontal upper surface of the printer casing 2 at one side of the sheet delivery opening 3, and the sectional area of the noise incident passage is substantially constant.

What is claimed is:

1. In combination, a noise reducing device and a printer comprising; a printer casing having an opening for delivering a printed sheet and a printed sheet guiding-receiving member extending from the printer casing at one side of the sheet delivering opening and having an upper surface for guiding and receiving the printed sheet delivered from the sheet delivering opening, said noise reducing device comprising a noise reducing hollow body having hollow ducts arranged at another side of the sheet delivery opening to oppose the printed sheet guiding-receiving member, each of said hollow ducts having a noise inlet opening to introduce a portion of noise radiating from the sheet delivery opening and a noise outlet opening in a direction facing the upper surface of the sheet guiding-receiving member, said sheet delivery opening being adapted for radiating the remaining portion of the noise along the upper surface of the sheet guiding surface.

2. A combination claimed in claim 1, wherein the noise reducing hollow body comprises a plurality of hollow ducts each having a different passage length, and the passage lengths are stepwise varied so that a hollow duct having the longest passage length is farthest from the sheet delivery opening.

3. A combination claimed in claim 2, wherein each of the hollow ducts respectively are formed in the form of a straight duct, and are arranged parallel to each other and to the sheet delivery opening side.

4. A combination claimed in claims 1 2, or 3, wherein, the hollow ducts all have the same sectional area.

5. A combination claimed in claim 1, wherein the noise reducing hollow body includes a noise incident passage extending from the sheet delivery opening to the inlets of hollow ducts, and the sectional area of the noise incident passage is gradually decreased from one end of the passage at the sheet delivery opening side to the other end.

6. A combination claimed in claim 5, wherein a noise entering angle defined between the noise incident passage and each of the hollow ducts is larger than 90°.

* * * * *